United States Patent [19]

Judge et al.

[11] 4,258,293

[45] Mar. 24, 1981

[54] HIGH INTENSITY DISCHARGE LIGHTING SYSTEM

[75] Inventors: Harold R. Judge, Alameda; Linda J. Harger, Oakland, both of Calif.

[73] Assignee: Cosmos Energy Innovation S.A., Sierre, Switzerland

[21] Appl. No.: 932,928

[22] Filed: Aug. 11, 1978

[51] Int. Cl.[3] ..... H05B 37/00

[52] U.S. Cl. ..... 315/203; 315/200 R

[58] Field of Search ..... 315/58, 208, 76, 129, 315/134, 135, 149, 151-153, 156, 200, 201, 203, 204, 208, 307

[56] References Cited

U.S. PATENT DOCUMENTS 3,675,073 3/1970 Hogue ..... 315/58

FOREIGN PATENT DOCUMENTS 1008710 11/1965 United Kingdom ..... 315/58

*Primary Examiner*—David K. Moore

*Attorney, Agent, or Firm*—Delbert J. Barnard

[57] ABSTRACT

An apparatus for connecting a high intensity discharge light to an electrical outlet has a plurality of end plates adapted to be electrically connected to an electrical outlet and to provide an electrical connection to the light. A heat sink means, and a cover means together with the end plates provide a protective enclosure for a circuit board having a ballast circuit thereon. The ballast circuit maintains a constant current flow through the light as the light becomes operational and comprises a plurality of transistor means biased both simultaneously and alternatively into conduction as the light becomes operational.

6 Claims, 2 Drawing Figures

HIGH INTENSITY DISCHARGE LIGHTING SYSTEM

DESCRIPTION

1. Technical Field

The present invention relates in general to ballast controls, and more particularly to ballast controls adapted for use in high intensity discharge lighting systems.

2. Background Art

Ballast circuits for starting and regulating the current flow through high intensity gas discharge lights are needed to prevent these lights from becoming damaged by drawing excessive line current during the turn on phases.

West et al., U.S. Pat. No. 3,801,867, issued Apr. 2, 1974, discloses a solid-state ballast circuit for starting and regulating a gaseous discharge lamp operated by direct current. West differs from the present invention in that West uses a constant current source wherein a voltage regulator controls the conduction of a first transistor means by biasing the first transistor to control the total current flowing through the lamp. The disclosed circuit is impractical in that the first transistor means must of necessity provide the entire control function for the lamp thereby making this transistor means an expensive, high voltage, high current-type transistor. The ballast circuit of the present invention overcomes this problem by providing the bias control for a transistor means from an inexpensive and more reliable resistive network means wherein heavy current drawn from an energy source is handled by a plurality of power-type resistors.

Mahaler, U.S. Pat. No. 3,486,069, issued Dec. 23, 1969, discloses a semiconductor ballast circuit for gas discharge lamps wherein a resistive network controls a transistor means. In Mahaler, the disclosed transistor means remains in a nonconductive state until the lamp becomes operational. This is particularly undesirable since in order for the disclosed circuit to become operational, a high starting current is needed. This high starting current requirement makes the conversion from an incandescent lamp to a gas discharge lamp difficult. The ballast circuit of the present invention overcomes this problem by having a plurality of transistors means both simultaneously and alternatively biased into conduction thereby minimizing the starting current required to ionize the gas within the light.

DISCLOSURE OF THE INVENTION

According to one aspect of the present invention, an apparatus for connecting a high intensity discharge light to an electrical outlet comprises a first end plate having an electrical plug extending therefrom adapted to be electrically connected to an electrical outlet. A second end plate, adjacent the first end plate and spaced apart therefrom, has an electrical socket therein adapted to provide an electrical connection to the high intensity discharge light. A circuit board containing a high intensity discharge light circuit thereon and adapted to electrically connect the socket to the plug is disposed between the first and second end plates and is secured therebetween. A heat sink means is disposed adjacent the circuit board and extends axially between the end plates. A cover means, having a plurality of vent means therein, is disposed on the other side of the circuit board and extends between the end plates such that the cover means, the end plates, and the heat sink means form a protective enclosure for the circuit board.

According to another aspect of the present invention, a ballast circuit for maintaining a constant current through a high intensity discharge light having two terminals therein with one terminal being connected to an electrical energy source comprises a voltage regulation means connected to the same terminal as the source of electrical energy. A first transistor means is connected to the other terminal of the high intensity discharge light with the first transistor means being biased into conduction by the voltage regulation means as the high intensity discharge light strikes. A second transistor means is connected to the first transistor means and the voltage regulation means with the second transistor means having one end of a zener diode means connected thereto. A resistive network means is connected to the same terminal as the first transistor means and to the other end of the zener diode means such that the resistive network means biases the second transistor means into conduction and the first transistor means out of conduction after the high intensity discharge light is struck. The resistive network means also biases the second transistor means out of conduction and the first transistor means back into conduction as the high intensity discharge light becomes operational, thereby maintaining a constant current flow from the electrical energy source through the high intensity discharge light as the light becomes operational.

The foregoing and other objects, features, and advantages of the present invention will become more apparent in light of the detailed description of preferred embodiments thereof set forth hereafter, and illustrated in the accompanying drawings.

BEST MODE OF CARRYING OUT THE INVENTION

Figure 1:
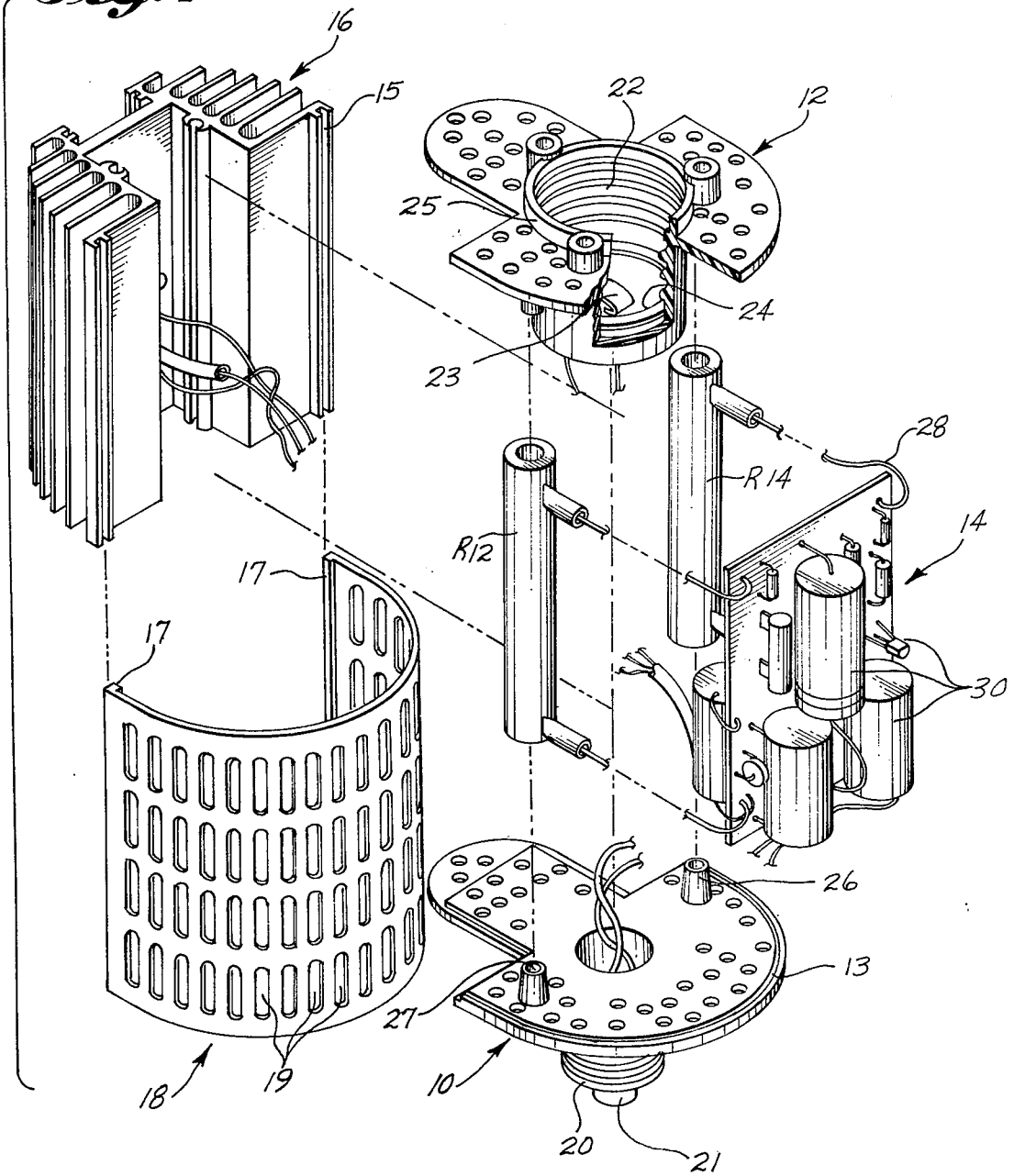
FIG. 1 is an exploded perspective view of one embodiment of a typical apparatus for connecting a light intensity discharge light to an electrical outlet according to the present invention.

In one embodiment of the present invention, as shown in FIG. 1, the apparatus for connecting a high intensity discharge light to an electrical outlet comprises a pair of spaced apart end plates 10, 12, a circuit board 14 disposed between the end plates 10, 12 and rigidly secured therebetween, a heat sink means 16 extending axially between the end plates 10, 12, and a cover means 18 also extending axially between the end plates 10, 12. The cover means 18, the end plates 10, 12, and the heat sink means 16 form a protective enclosure for the circuit board 14.

End plate 10 abuts one end of the circuit board 14 and has an electrical mogul-type or a medium-type plug 20 extending therefrom adapted to provide an electrical connection between a standard electrical outlet, such as a one hundred twenty volt, sixty hertz energy source, and the circuit board 14. The plug 20 has a tip 21 extending therefrom to provide a low resistive positive connection with an electrical outlet and to prevent oxidation of the tip. End plate 12 abuts the other end of the circuit board 14 and has an electrical socket 22 disposed therein and provides a receptical means and an electrical connection to the high intensity discharge light. The electrical socket 22 has nonconducting threads disposed circumferentially around the inside surface therein with a metal collector ring 24 and a center tip 23 disposed at the bottom of the socket adapted to provide an electrical connection between the high intensity discharge light and the circuit board 14. By constructing the threads within the electrical socket 22 from a nonconductive material, such as plastic or the like, and by locating the metal collector ring 24 at the bottom of the socket 22, a high intensity discharge light (not shown) may be seated and secured within the socket 22 without the occurrence of an electrical shock. The socket 22 has a nonconductive rim 25 extending above the end plate 12 to cover the metal threads on the high intensity discharge light when the light is seated and secured within the socket.

Figure 2:
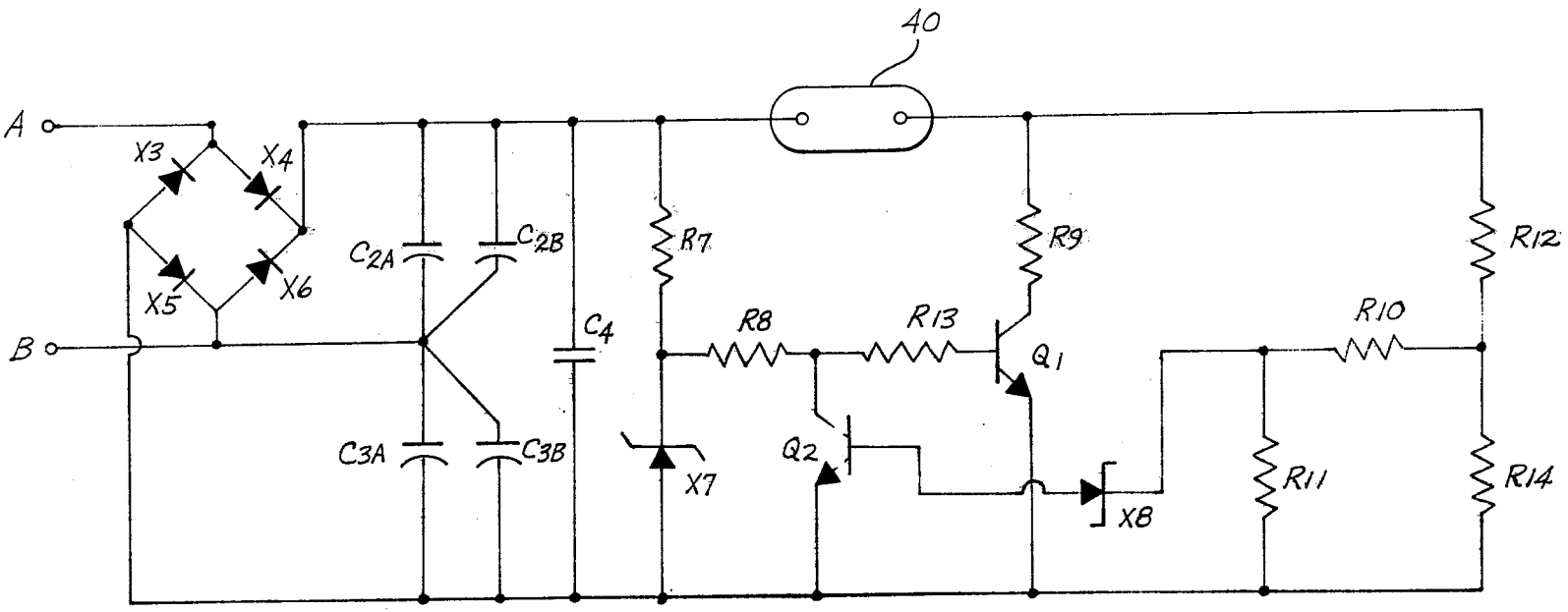
FIG. 2 is an electrical schematic diagram of a typical ballast circuit for a high intensity discharge light according to the present invention.

The circuit board 14 extends axially between the end plates 10, 12, and has a high intensity discharge light electrical circuit (shown schematically in FIG. 2) disposed thereon, and a plurality of electrical components, shown generally at 30, secured thereto. The electrical circuit is disposed upon the circuit board 14 by means which are old per se, such as by the use of a printed circuit, or the like. With reference to FIG. 2, the circuit board 14 contains electrical components that typically have a low wattage output. As will be discussed more fully below, resistors R12, R14, generate substantially more heat than the other components 30 on the circuit board 14 and are therefore spaced outwardly from the circuit board. The resistors R12, R14 abut end plates 10, 12, extend axially therebetween, and are in close proximity to the heat sink means 16. The resistors R12, R14 are secured between end plates 10, 12 by a plurality of mounting studs 26 disposed upon each end plate and adapted to insert into each end of resistors R12, R14. Each mounting stud has a hole 27 therein to allow air to circulate through the centers of the resistors R12, R14. The resistors R12, R14 are connected to the circuit board 14 by a flexible wire 28 to facilitate connecting the resistors to the circuit board.

A heat sink means 16 is disposed above the circuit board 14 and extends axially between end plates 10, 12. The heat sink means 16 is adapted to carry transistor means Q1 thereon, and is adapted to evenly distribute the heat generated by transistor means Q1. The heat sink 16 is secured to end plates 10, 12 such as by the use of rivets or the like. In the preferred embodiment the heat sink means 16 is black anodized aluminum to provide approximately twenty-five percent more heat dissipation capability over that provided by bare aluminum. The anodized aluminum also provides a nonconductive hardened finish to the heat sink.

The cover means 18 is formed to include a plurality of vent openings. Cover means 18 is secured to the heat sink 16 by a groove 15 disposed on each side of the heat sink and a tongue means 17 disposed on each end of the cover means 18. A groove 13 disposed within each edge plate 10, 12 secures each end of the cover means to the end plates. Cover means 18, the end plates 10, 12, and the heat sink means 16 form a protective enclosure for the circuit board 14. A safety plate (not shown) covers a transistor which is mounted on the heat sink 16.

A reflector means having a highly reflective interior surface (not shown) is adapted to be secured to end plate 12 and partially surround the high intensity discharge light and provides a means to increase and more uniformly distribute light upon a surface. The reflector can be made from any suitable material such as aluminum or the like having a low copper composition. In the preferred embodiment the reflector means is a segmented parabola to match the arc light source within the high intensity discharge light.

With reference to FIG. 2, a ballast circuit for maintaining a constant current through a high intensity discharge light generally comprises an electrical energy source connected to one terminal of the light, a voltage regulation means connected to the same terminal of the light, a first transistor means connected to the other terminal of the light, a second transistor means connected to both the first transistor means and the voltage regulation means, and a resistive network connected to the same terminal of the light as the first transistor means and to the second transistor means through a zener diode means.

Input power, such as provided by a conventional one-hundred twenty volt, sixty hertz source, is applied to the ballast circuit at points A and B and also to a bridge rectifier circuit comprising a plurality of diodes X3, X4, X5, X6. The bridge rectifier circuit is old per se, and provides a rectified signal to a doubling capacitor network formed by capacitors C2, C3, and a filter capacitor C4. In the preferred embodiment, diodes X3, X4, X5, and X6 are typically General Electric 400 volt, 3 to 5 ampere diodes.

A doubling capacitor network, comprising capacitors C2, C3, provides an increased source of electrical energy to one terminal of the light, shown at 40, to enable the light to strike (to initially ionize the gas within the light). By way of example, during the time period when an input sinusoidal signal applied at terminals A and B is positive, diodes X4, X5 are biased into forward conduction thereby allowing capacitor C2 to charge. Filter capacitor C4 also charges during this period through diodes X4, X5. During the time period when the input sinusoidal signal is negative, diodes X4, X5 are back biased to a nonconductive condition, and diodes X3, X6 are biased into forward conduction. During this time, doubling capacitor C3 charges through diode X3, and filter capacitor C4 charges through diodes X3, X6. In the preferred embodiment, and for either a one hundred seventy-five watt or a one hundred watt high intensity discharge light, the charging capacitor C2 is comprised of two capacitors connected in a parallel manner with each capacitor being a five microfarad, 125 volt AC capacitor. For these lights, charging capacitor C3 also comprises two capacitors connected in a parallel manner with each capacitor being a 10 microfarad, 125 volt AC capacitor. These capacitors are commercially available and are typically manufactured by Cornell-Dubiliar. For a fifty watt high intensity discharge light doubling capacitors C2, C3 are typically Cornell-Dubiliar five microfarad, 125 volt AC capacitors. The filtering capacitor C4 is selected based upon the wattage rating of the light. For a one hundred seventy five watt light, C4 is typically sixty microfarads 300 volt DC. For a fifty watt lamp, C4 is 40 microfarad 300 volt DC. In the preferred embodiment capacitor C4 is manufactured by Sprague or Mallory.

A voltage regulator is connected to one terminal of the light and generally comprises a resistor R7 connected in series with the cathode side of a zener diode means X7. Resistor R7 is typically a 5,000 ohm, 8 watt resistor manufactured by Ohmite, and zener diode means X7 has a 20 volt breakdown rating at one watt and is manufactured by Sylvania.

A first transistor means Q1 is connected through the collector region by thermistor R9 to the other terminal of the light. A plurality of resistors R8, R13 are connected to the base region of the first transistor means Q1 and to the cathode side of the zener diode means X7 within the voltage regulator. A second transistor means Q2 is connected through the collector region to both the first transistor means Q1 and the voltage regulator. In addition, the second transistor means Q2 has a zener diode means X8 connected to the base region of the second transistor means. In the preferred embodiment, R9 is typically 120 ohms at one amp when cold, and 5 ohms at one amp when warm. R9 is a commercially available thermistor such as typically manufactured by Carborendum. First transistor means Q1 is a silicone power transistor, typically Model No. DTS 401 such as manufactured by Delco. Second transistor means Q2 is also a silicone transistor, typically Model No. 2N1613 manufactured by RCA. Zener diode means X8 has a 27 volt breakdown voltage at 400 milliwatts and is manufactured by Texas Instrument. Resistor R8 is a selected carbon resistor and can assume values from between 300 ohms to 5,100 ohms at one watt.

A resistive network means comprising resistors R10, R11, R12, R14 is connected to both the same terminal as the first transistor means Q1 and to the cathode end of the zener diode means X8. Resistor R11 is a 470 ohm, one half watt carbon resistor. Resistors R12, R14 are wire wound resistors adapted to dissipate from between 20 and 50 watts of power and range from 25 ohms to 150 ohms.

OPERATION OF THE BALLAST CIRCUIT

Upon initial application of a conventional one hundred twenty volt, sixty hertz source at terminals A-B, the bridge rectifier, doubling capacitors C2, C3 and filtering capacitor C4 provide typically a 290 volt DC electrical signal to one terminal of the high intensity discharge light. Since zener diode means X7 has a typically 20 volt reverse breakdown voltage, a 20 volt DC signal exists at the junction between R7 and X7 which is sufficient to cause the base to emitter junction of the first transistor means Q1 to become forward biased and conduct current through R7, R8, and R13. During this time, typically milliseconds, the gas within the light has not begun to ionize, and the light has essentially an open circuit between the two terminals. As the light strikes, the voltage at the output of the capacitor doubler network C2, C3 and the filter capacitor C4 is reduced to typically 130 volts DC, with the voltage drop across the light being typically 15 volts. At this time, the voltage at one end of the thermistor R9 and the resistive network means is sufficient to cause zener diode means X8 to conduct current through the base region of second transistor means Q2 thereby causing second transistor means Q2 to saturate and force the first transistor means Q1 into the nonconductive condition. As the gas within the light continues to ionize, the voltage drop across the terminals of the light increases to typically 95 volts. As this occurs, zener diode means X8 becomes back biased forcing second transistor means Q2 out of saturation and first transistor means Q1 back into the forward conduction mode. Current flowing through the terminals of the light is then conducted through the thermistor R9 and the collector to base region of first transistor means Q1. In this manner, as the light progresses from becoming initially ionized to fully operational, the current flowing through the terminals of the light remains constant.

INDUSTRIAL APPLICABILITY

The present invention has application in any situation where it is desirable to quickly, easily and economically convert a conventional incandescent lighting system to one using high intensity discharge lights.

We claim:

1. An apparatus for connecting a space lighting high intensity discharge light to an electrical outlet socket for an incandescent light, comprising:
   (a) a first end plate having an electrical plug extending therefrom adapted to be electrically connected to said electrical outlet socket;
   (b) a second end plate spaced apart from said end plate and having an electrical socket therein adapted to provide an electrical connection to a high intensity discharge light;
   (c) a circuit board containing a high intensity discharge light electrical circuit thereon adapted to electrically connect said socket to said plug, said circuit board being disposed between said first end plate and second end plate and secured therebetween;
   (d) a heat sink means positioned laterally adjacent said circuit board and extending axially between said end plates; and
   (e) a cover means having a plurality of vent means therein, said cover means being positioned laterally adjacent said circuit board extending between said end plates such that said cover means, said end plates, and said hearsink form a protective enclosure for said circuit board.

2. The apparatus of claim 1 wherein said high intensity discharge electrical circuit further includes a plurality of high watt resistive circuit further includes a plurality of high watt resistive means extending axially between said end plates and disposed laterally outwardly from said circuit board and in close proximity to said heat sink means such that heat generated therefrom is dissipated by said sink means.

3. The apparatus of claim 2 wherein said high wattage resistive means constitutes at least one tubular resistor, and said end plates including studs for mounting said resistor, each having a hole therein and adapted to insert into an end of said resistor such that air circulates through said resistor.

4. The apparatus of claim 1 wherein said electrical socket has nonconductive threads therein with a metal conductor ring disposed at the bottom thereof in position to make contact with conductive threads on a high intensity discharge light, said socket adapted to prevent a shock as said high intensity discharge light is seated and secured within said electrical socket.

5. The apparatus of claim 4 wherein said socket has a nonconductive rim extending endwise outwardly from said second end plate, said rim covering the metal threads of said light as said ight is seated and secured within said socket.

6. The apparatus of claim 1 wherein said heat sink means is a wall member constructed from black anodized aluminum.

* * * * *